US005920944A

United States Patent [19]

Biggs et al.

[11] Patent Number: 5,920,944

[45] Date of Patent: Jul. 13, 1999

[54] ERGONOMIC MOP APPARATUS

[76] Inventors: Blyth S. Biggs, P.O. Box 217, Carmelia Bay, Calif. 96140; Brenden Biggs, 18 Brown Dr. Unit #1, Carson City, Nev. 89706

[21] Appl. No.: 09/073,016

[22] Filed: May 4, 1998

[51] Int. Cl.[6] ..... B25G 1/04; B25G 1/10; B25G 1/00; A47L 13/20

[52] U.S. Cl. ..... 15/144.4; 15/143.1; 15/229.2; 16/111 R; 16/115; D32/50; D32/51

[58] Field of Search ..... 15/143.1, 144.1, 15/144.2, 144.3, 144.4, 145, 228, 229.1–229.9; 16/110 R, 111 R, 115; D32/50–52

[56] References Cited

U.S. PATENT DOCUMENTS

| | | | |
|---|---|---|---|
| 207,427 | 8/1878 | Lamboy | 15/143.1 |
| D. 359,605 | 6/1995 | Janikowski | D32/51 |
| D. 388,934 | 1/1998 | Ames, Jr. et al. | D4/132 |
| 1,315,194 | 9/1919 | Yamamoto | 15/143.1 X |
| 4,704,758 | 11/1987 | Hoffman | 15/143.1 X |
| 4,809,388 | 3/1989 | Dietrich | 15/143.1 |
| 5,133,101 | 7/1992 | Hauser et al. | 15/143.1 |
| 5,581,839 | 12/1996 | Ferrell, Jr. | 15/143.1 |
| 5,606,772 | 3/1997 | Ilic | 16/114 R |
| 5,771,535 | 6/1998 | Blessing | 16/110 R |

*Primary Examiner*—Mark Spisich
*Attorney, Agent, or Firm*—Herbert C. Schulze

[57] ABSTRACT

A mop handle and method of mopping including a unique construction of a mop handle which consists of a cylindrical elongate handle having an offset intermediate its ends and a rotatable swivel grip on one end, which enables the user of a mop with said handle to mop more efficiently and with reduced risk of injury including repetitive motion injuries and the like.

5 Claims, 2 Drawing Sheets

ERGONOMIC MOP APPARATUS

BACKGROUND OF THE INVENTION

I. Field of the Invention

This invention is in the general field of a mop for mopping floors, decks, and the like;

This invention is more particularly in the field of such a mop designed to relieve excess stress and fatigue for the user of the mops;

This invention is even more particularly in the field of such a mop designed to relieve stress and fatigue and the danger of injury to the user;

This invention is most particularly in the fields above mentioned and in the field of a mop handle designed to accomplish all of this and to allow for a much larger work space from one position for the user than is customary.

II. Description of the Prior Art

Mops have been known for centuries. All mops share the common characteristic that they consist of an elongated rod for a handle with mopping material consisting of a bundle of strands of yarn, absorbent string, sponge, or the like on one end of the rod, the length of the rod generally being a few feet, terminating in a plain end on the rod. All mops known to us are of the above configuration.

The mop of this invention is completely different from the prior art. our invention is a mop with a longer than normal handle being provided with unique angularly offset portions and terminating in a unique swivel hand grip on the end not carrying the mopping material.

In the sense described above, we believe there is no true prior art to our invention described in this specification.

SUMMARY OF THE INVENTION

A mop is one of the most widely used of all implements. Going into a super market, one will see a clerk mopping a spill; Going onto a deck, one will see a mop being used; Staying in a hotel, one will see a mop; In the average home, one will see a mop; Mops literally pervade every aspect of civilized (and even uncivilized) life.

However, the life of one wielding a mop is not easy. Users of mops suffer from many discomforts and disabilities. The customary mop is a very troublesome implement. Many serious, and continuing, injuries and discomforts result from the use of mops.

Additionally, mopping is a very inefficient process due to the restrictive nature of the mop.

We have been engaged in mopping and have studied mopping seeking relief from the problems associated with mopping and attempting to perfect a more desirable mopping procedure.

We have now developed a superior, unusual, and unique mop and mopping technique.

We have conceived and developed a mop (primarily the mop handle) which solves all of the problems associated with mopping, and which no one has conceived before.

We have designed a mop incorporating an unusual and unique design, together with a special swivel top handle arrangement which eliminates the former problems with mops and produces a superior mop capable of producing more mopping results with less effort and no injuries or fatigue.

We have done this by making a special offset handle design with a unique top swivel handle support member.

It is an object of this invention to provide a mop which will extend the effective mopping area from any given position;

Another object of this invention is to provide a mop which will diminish fatigue for the user of the mop;

Another object of this invention is to provide a mop which can be used with virtually no danger of injury;

Another object of this invention is to provide a mop which can be used with reduced danger of carpel tunnel syndrom or other repetitive motion injury;

Still another object of this invention is to provide a mop which can reduce the time required to mop any given area.

The foregoing and other objects and advantages of this invention will be understood by those skilled in the art upon reading the description of a preferred embodiment in conjunction with a review of the appended drawings.

DESCRIPTION OF A PREFERRED EMBODIMENT

Figure 1:
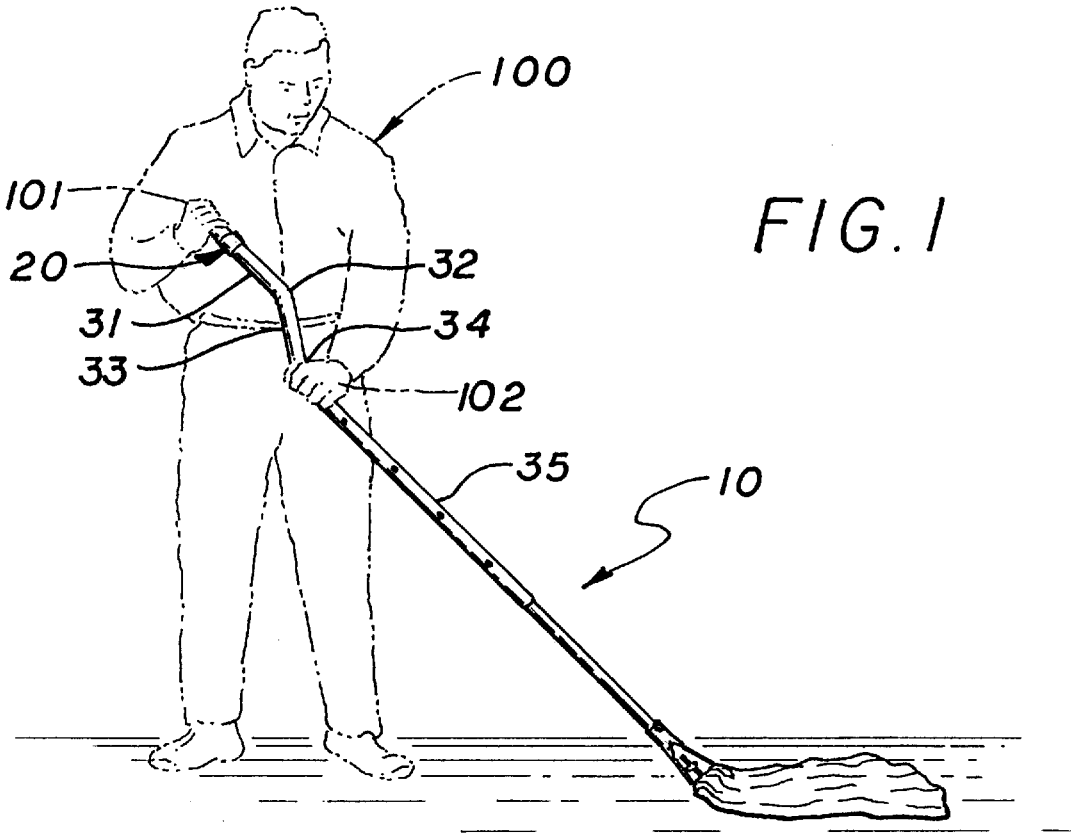
FIG. 1 is a perspective of a mop suitable to practice the method of this invention, showing a user of the mop in phantom.

The elements of the invention bearing reference numerals are:

| Reference numeral | Description |
|---|---|
| 10 | mop, generally |
| 20 | swivel, generally |
| 21 | swivel inside stem |
| 22 | swivel stem insert into handle element 31 |
| 22a | swivel stem insert shoulder |
| 23 | swivel stem enlargement |
| 23a | swivel stem enlargement shoulder |
| 24 | swivel stem shoulder cut out |
| 25 | swivel hand grip |
| 25a | cylindrical passage through hand grip |
| 26 | swivel handle shoulder enlargement |
| 26a | lower edge of shoulder enlargement |
| 27 | swivel handle cap |
| 28 | swivel stem enlarged upper interior |
| 28a | swivel hand grip interior upper shoulder |
| 29 | swivel hand grip enlarged lower cavity |
| 29a | swivel handle interior lower shoulder |
| 30 | upper mop handle segment, generally |
| 31 | first upper mop handle portion |
| 32 | first bend in upper mop handle portion |
| 33 | second upper mop handle portion |
| 34 | second bend in upper mop handle portion |
| 35 | third upper mop handle portion |
| 36 | holes in upper mop handle portion |
| 40 | lower, telescoping, mop handle portion |
| 41 | spring loaded balls in telescoping portion |
| 42 | holes in telescoping portion |
| 50 | mop and stirrup assembly, generally |
| 51 | mop and stirrup connection socket |
| 52 | mop stirrup |
| 53 | mop |

-continued

| Reference numeral | Description |
|---|---|
| 54 | holes in socket |
| 100 | mop user |
| 101 | right hand |
| 102 | left hand |

FIG. 1 shows how a user 100 will use our new ergonomic mop handle in mopping an area. A person normally will use our new handle 10 with mop 53 by holding the swivel portion 20 with his or her right hand 101, as shown, with the left hand 102 gripping the third upper handle portion 35 beneath the offset bend 34 (depending upon individual preferences the hand positions may be reversed). In this manner the person doing the mopping can guide the mop in a wide sweep covering a greater area than is possible with a customary mop and handle, and with very little effort and none of the injury producing effects of the use of a normal mop.

In particular our unique mop handle design can more easily reach the mop under and around objects such as toilets, sink baskins, etc. No other mop has ever been able to do this connected to any heretofore known handle.

Figure 7:
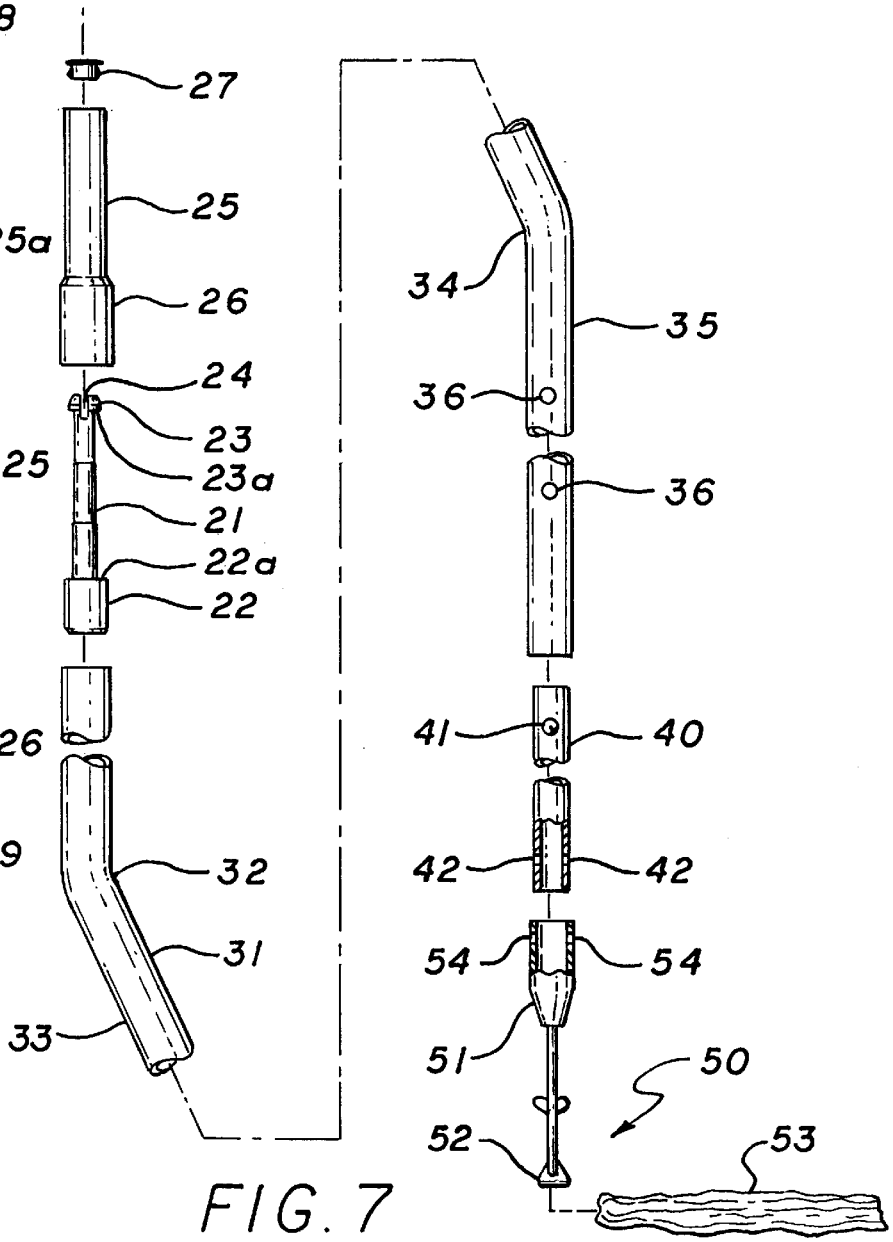
FIG. 7 is an exploded view of the mop of FIG. 1.

Exploded view FIG. 7 should be examined by those skilled in the art in order to clearly understand the many cooperative and unique features of this invention. FIG. 7, along with the other figures, make the unusual nature of this invention clear.

The swivel handle 20 at the upper end of the handle consists of an elongate cylindrical plastic rod 21 having an enlarged upper end 23 with a slot 24 to allow the enlarged portion to bend together to enter the cylindrical cavity 25*a* in the cylindrical plastic member 25. When the cylindrical portion 21 is fully inserted into the cylindrical portion 25 the enlarged portion 23 will snap back out. A cap 27 fits into and closes the top of the enlarged interior cavity 28. At this point, the shoulder 23*a* will rest rotatably upon the shoulder 28*a* of the cavity 28 within the hand grip 25 and the shoulder 29*a* of the enlarged lower cavity 29 of the hand grip will rest rotatably on the shoulder 22*a* of enlarged end 22. The end 22 will be secured by adhesive, a pin, bolt, or the like within the tubular handle portion 31. The end 26*a* preferably terminates on the exterior of handle portion 31.

Figure 2:
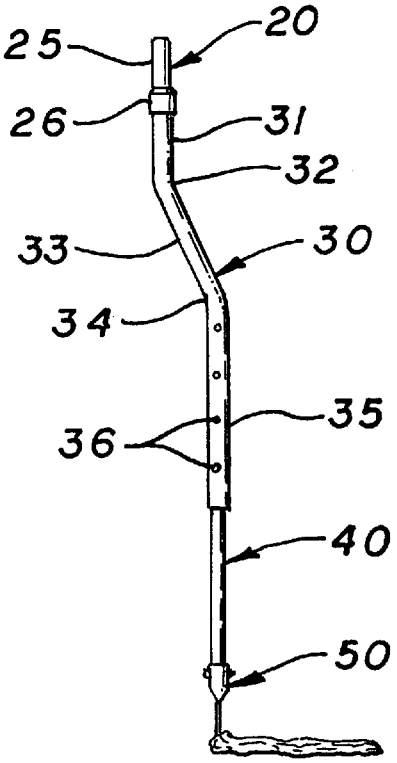
FIG. 2 is a right side elevation of the mop of FIG. 1, the left side elevation being a mirror image of FIG. 2.
Figure 3:
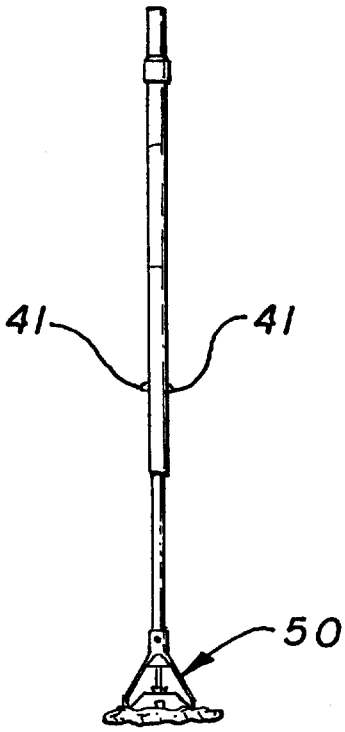
FIG. 3 is a front elevation of the mop of FIG. 1.
Figure 4:
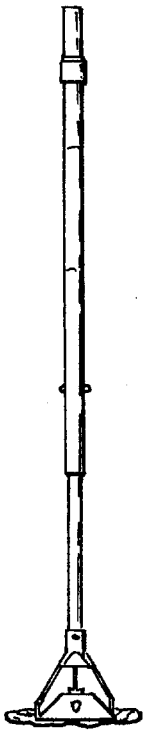
FIG. 4 is a back elevation of the mop of FIG. 1.
Figure 5:
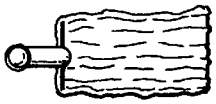
FIG. 5 is a top elevation of the mop of FIG. 1.
Figure 6:
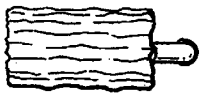
FIG. 6 is a bottom elevation of the mop of FIG. 1.
Figure 8:
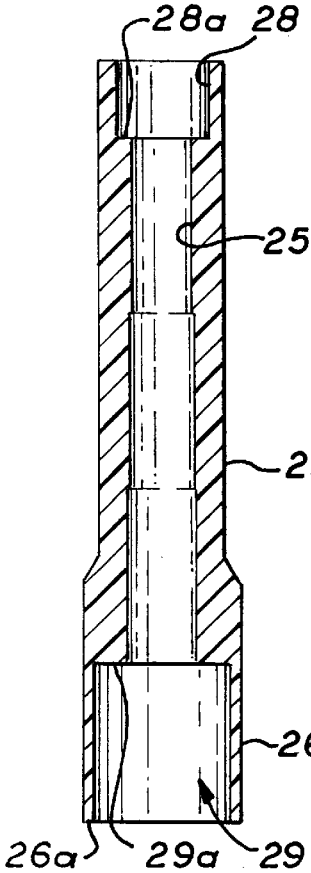
FIG. 8 is an enlarged sectional view of element 25–26.

The handle 30 is formed of aluminum tubing or the like. The handle is particularly well shown in FIG. 2. The swivel 20 is shown in place in the tubing portion 31 above a first offset bend 32. Bend 32 and a second bend 34 define a portion 33 of the handle. Each bend will preferably be in the range of 20 to 25 degrees from the axis of tubing portions 31 and 35 which will be parallel to each other. The individual portions of the handle should be in the approximate proportions to those proportions shown in the drawings. In actuality, the over handle length will be about 52 inches long, with adjustment of length possible due to the telescoping lower portion 40. Adjustment of length is provided by depressing spring loaded balls 41 and moving to a different set of holes 36 where the spring loaded balls will snap in place to lock in the adjusted position (note that only one ball and one set of holes is shown, but there is another 180 degrees from those shown, thus not visible in the drawings).

Holes 42 are provided on the sides to allow for fastening of the mop assembly 50 consisting of stirrup 52 and mop 53 by insertion of a bolt through holes 54 which are in the sides of the mop stirrup socket 51 and holes 42 which are in the telescoping portion 40. Other means of fastening the mop could be used if desired.

Certain materials or elements have been named such as plastic, aluminum, bolts, spring loaded balls, etc. While the definition of such materials or elements may, in some instances be inventive in themselves, it is not intended that such terms be completely definitive nor limiting. The substitution of other suitable materials or elements is intended to fall within the scope of this invention as set forth in the claims.

While the embodiments of this invention shown and described are fully capable of achieving the objects and advantages desired, such embodiments have been shown for purposes of illustration only and not for purposes of limitation.

We claim:

1. A mop handle comprising: a first elongate cylindrical member having a first end and a second end; a first angular bend and a second angular bend intermediate the first and second ends in such manner that the portion of said mop handle between the first end and the first bend and the portion of said mop handle between the second end and the second bend are parallel but in different, offset, planes, and the portion between the second end and the second angular beend is suitable to be gripped by a human hand; and a swivel grip on said first end of said first elongate cylindrical member consisting of: a first elongate hollow cylindrical member having a first end closed by a removable cap and a second enlarged end, a first shoulder within said first hollow cylindrical member adjacent said cap, a second shoulder within said second enlarged end, a second solid cylindrical member inserted into said first hollow cylindrical member having a first enlarged end engaged with said first shoulder within said first hollow cylindrical member, and a second enlarged end engaged with said second shoulder within said second enlarged end of said first hollow cylindrical member affixed on the first end, and a second elongate cylindrical member removably inserted within the first elongate cylindrical member.

2. A mop handle comprising: a first elongate cylindrical member having a first end and a second end; a first angular bend and a second angular bend intermediate said first and second ends in such manner that the portion of said mop handle between the first end and the first bend and the portion of said mop handle between the second end and the second bend are parallel but in different, offset, planes, and the portion between the second end and the second angular bend is suitable to be gripped by a human hand; a swivel grip affixed on the first end suitable to be gripped by a human hand consisting of a first elongate hollow cylindrical member having a first end closed by a removable cap and a second enlarged end, a first shoulder within said first hollow cylindrical member adjacent said cap, and a second shoulder within said second enlarged end, a second solid cylindrical member having a first enlarged end engaged with said first shoulder within said first hollow cylindrical member, inserted into said first hollow cylindrical member and a second enlarged end engaged with said second shoulder within said second enlarged end of said first hollow cylindrical member affixed on the first end; and a second elongate cylindrical member removably inserted within the first elongate cylindrical member.

3. A mop handle comprising: a first elongate cylindrical member having a first end and a second end; a first angular bend and a second angular bend intermediate the first and second ends in such manner that the portion of said mop handle between the first end and the first bend and the portion of said mop handle between the second end and the second bend are parallel but in different, offset, planes, the portion between the second end and the second angular bend belong suitable to be gripped by a human hand; and a rotatable hand grip consisting of an elongate cylindrical member having a bearing surface inside, and cooperable with, the said first end of said first elongate cylindrical member in a rotatable relationship therewith.

4. A mop comprising: a first elongate cylindrical member having a first end and a second end; a first angular bend and a second angular bend intermediate the first and second ends in such manner that the portion of said mop handle between the first end and the first bend and the portion of said mop handle between the second end and the second bend are parallel but in different, offset, planes, and the portion between the second end and the second angular bend is suitable to be gripped by a human hand; and a rotatable hand grip consisting of a first elongate hollow cylindrical member having at least one internal bearing surface and a second cylindrical member inserted into said first hollow cylindrical member, said second cylindrical member having a deformable disengageable engagement member engaged with said internal bearing surface of the first elongate hollow cylindrical member affixed on the first end; and a mop assembly affixed to the second end.

5. A mop handle comprising: an elongate hollow cylindrical member having a first end and a second end; means to attach a mop head on the second end; an elongate, rotatable, cylindrical handle depending from the first end at its extremity most distant from the second end; a first angular bend in said elongate hollow cylindrical member at a spaced distance from said first end, said first angular bend being at en obtuse angular relationship to the portion of the elongate hollow cylindrical member between its first end and the first angular bend; a second angular bend being a mirror image of the first angular bend intermediate the first angular bend and the second end such that the portions of the elongate hollow cylindrical member between the first end and the first angular bend and the second end and the second angular bend are parallel in different, offset, planes.

* * * * *